United States Patent [19]

Terazawa et al.

[11] 3,964,843

[45] June 22, 1976

[54] SEAL MEANS FOR ROTARY PISTON ENGINE

[75] Inventors: Yasuto Terazawa; Fumio Imamaru, both of Hiroshima, Japan

[73] Assignee: Toyo Kogyo Co., Ltd., Japan

[22] Filed: Dec. 31, 1974

[21] Appl. No.: 537,822

[30] Foreign Application Priority Data

Jan. 14, 1974 Japan ..... 49-7640

[52] U.S. Cl. ..... 418/83; 418/149; 123/8.01; 277/233; 277/235 R

[51] Int. Cl.[2] ..... F01C 19/00; F01C 21/06; F02B 53/00; F02F 11/00

[58] Field of Search ..... 418/83, 149; 123/8.01; 277/233, 234, 235 R

[56] References Cited

UNITED STATES PATENTS

| | | | |
|---|---|---|---|
| 3,330,568 | 7/1967 | Wetzel | 277/235 |
| 3,575,538 | 4/1971 | Berkowitz et al. | 418/149 |
| 3,627,337 | 12/1971 | Pippert | 277/233 |
| 3,695,790 | 10/1972 | Jones | 418/149 |
| 3,844,694 | 10/1974 | Lamm | 418/149 |

*Primary Examiner*—John J. Vrablik

*Attorney, Agent, or Firm*—Wenderoth, Lind & Ponack

[57] ABSTRACT

A seal means which is mounted in a groove means provided between the working chamber and coolant flow passages of a rotary piston engine and is constituted by a main member which is compressively flexed between the groove means and the opposite mating surface of a housing, a first backup element made of a flexible material and a second backup element made of a metal which are provided on the outer side of the main member, and a heat-resistant element which is provided on the inner side of the main member, the first and second backup element preventing movement of main member portions into any gap formed between housing mating surfaces at an interface, whereby the main member is protected from wear and the service life of the seal means is increased.

17 Claims, 6 Drawing Figures

SEAL MEANS FOR ROTARY PISTON ENGINE

BACKGROUND OF THE INVENTION

The present invention relates to a seal means for an internal combustion engine such as a rotary piston engine which are provided at the interfaces of housings defining an engine working chamber and having formed therein passages constituting a circuit for flow of fluid coolant, and each of which is mounted in a groove means provided between the working chamber and coolant flow passages in at least one mating surface of a housing at an interface.

A rotary piston engine employs am epicyclically driven three-lobe rotor rotating in a chamber which is defined by a main engine casing including a main rotor housing having two open sides and having a generally trochoidal inner peripheral surface constituting a chamber wall contactable by the lobes of the rotor, and two side housings fixedly attached to opposite sides of and enclosing the open sides of the main housing, and which is divided by the rotor into three gas-tight compartments, the volume of each of which is varied as the rotor rotates, an explosive mixture supplied into the chamber via an intake port being compressed as the rotor rotates, and then ignited by a spark plug to produce an explosion providing force to continue rotation of the rotor, and exhaust gases being driven by the rotor to an exhaust port leading out of the chamber, during which time another intake of explosive mixture is supplied into the chamber. A commonly employed method for removal of heat resulting from the combustion processes taking place within the chamber is to circulate a fluid coolant in passages which are formed in the actual bodies of the main housing and side housings, passages formed in opposite side housings being in communication with passages formed in the main housing. Although side housings are fixedly attached to and are initially mounted in comparatively flush fit to the main housing, after the engine has been in service for a certain time there is inevitably some displacement of the side housings relative to the main housing, and thee are also produced narrow gaps between mating surfaces of the main housing and side housings, particularly since it is the practice to make the main housing and side housings of dissimilar metals, which may provide different electrode potentials promotive of electrochemical corrosion, and which have different temperature-expansion coefficients and therefore tend to move in frictional contact with one another in response to temperature variations accompanying successive cycles of engine operation, corrosion of housing surfaces at gaps formed being further encouraged by the electrolytic action of coolant infiltrating therebetween. Since the coolant flow passages formed in the main housing or a side housing open onto the mating surface thereof, to prevent coolant which is circulated in these passages from passing through a gap between mating surfaces and leaking into the working chamber of the engine, it is the practice to provide at each interface, i.e., where each pair of mating surfaces meet, seal means located between coolant passages and the working chamber and generally constituted by a ring which surrounds the periphery of the working chamber and is fitted into a groove formed in the mating surface of either the main housing or the side housing, and has dimensions such that it projects slightly from the groove when it is seated therein, whereby when the main and side housings are in an assembled condition the seal means is pressed firmly against the opposite mating surface. Qualities required of such a ring include of course good heat and corrosion resistance, and also, in order to ensure that the ring presses against the opposite mating surface in good sealing contact, the ring is required to have a certain degree of flexibility, and is therefore suitably made of an elastomeric material. However, since the ring is flexible, due to the effects of vibration and other motion when the engine is in operation, face and side corner portions of the ring may easily work into gaps formed at the housing interfaces, where they are subject to rapid deterioration and wear, thus permitting further ring portions to work into the gaps and resulting in failure of the seal means. To counter this phenomenon it has been known to provide the seal ring with a backup layer or element constituted by a thin metallic strip, which is annular in form and is provided in the seating groove and in contact with the outer side of the seal ring, i.e., the side thereof which is outermost with respect to the working chamber and closer to the coolant flow passages of the housing in which the seating groove is formed. By the nature of metallic products, this backup strip, as well as being strong is comparatively rigid, and it is not possible even initially to ensure a completely flush fit between the backup element and the opposite mating surface, even if the dimensions of the backup element are such that the element is pressed firmly against the opposite mating surface when the housings are assembled, in addition to which the backup element being of a comparatively thin cross section is particularly sensitive to the effects of corrosion or abrasion, with the result that there is always, or there is rapidly formed a gap between the backup element face and the mating surface of the opposite housing. Under the influence of even comparatively minor vibrations the main seal member of elastomeric material is liable to work into this gap, and in the extreme case is able to advance as far as the gap between housing mating surfaces and is subject to deterioration resulting in failure, as described before. Alternatively it has been known to provide the backup element in the form of a ring of strong but comparatively flexible material such as polytetrafluoroethylene. Such a backup element is able to be pressed firmly against a mating surface so as to leave no gap into which corner portions of the main member may work due to minor vibrations of the engine. However, when there occur vibratory or other forces able to cause a comparatively great deflection of the main member, the backup element, also being non-rigid, bends together with the main member and permits main member corner portions to move into a gap at an interface, again leading to failure of the seal means. To render a backup element made of polytetrafluoroethylene or similar material more rigid, it has been proposed to make the backup element thicker. But since housings must accommodate coolant flow passages, constitute a rigid outer casing defining the working chamber, and at the same time not be excessively bulky or heavy, there are constructional limitations on the permitted size of the groove for accommodation of the seal means, and increasing the thickness of the backup element therefore necessitates decreasing that of the main seal member, which consequently fails to function satisfactorily as a seal means.

SUMMARY OF THE INVENTION

The present invention has an object to provide a seal means which is associable with a rotary piston engine casing for the purpose of prevention of leakage into an engine working chamber of coolant from coolant flow passages formed in the main and side housings constituting the case and defining the working chamber, and which permits adequate protection of a main seal member from wear without requiring excessive reduction in the thickness thereof. According to the invention, at each interface of a main housing and side housings fixedly mounted together to define a working chamber of a rotary piston engine there is provided a seal means in a groove means which is suitably constituted by a generally elliptical, endless groove, which is formed in the mating surface of the main housing or of a side housing, and which when the housings are in an assembled condition is located between coolant flow passages formed in the housings and the engine working chamber defined thereby. Each seal means comprises a main member made of a heat-resistant elastomer, the width from the face to the rear edge of which is slightly greater than the depth of the seating groove, whereby the member is compressed when housings are assembled and the face thereof is held in good sealing contact with the opposite mating surface, a first backup element which is made of a fluoric resin such as polytetrafluoroethylene, is flexible but less so than the main member, has approximately the same width as but is thinner than the main member, and is provided in immediate contact with the main member on the outer side thereof, i.e., the main member side which is outermost with respect to the engine working chamber, a second backup element which is constituted by a thin metallic strip provided in immediate contact with the outer side of the first backup element and having a width which is slightly less than that of the first backup element and is sufficient to ensure that the second backup element face presses against an opposite mating surface, and a heat-resistant element which is provided in contact with the inner side of the main member. During major flexion of the main member, movement thereof into a gap between mating surfaces of the housings is prevented by the second backup element, and during minor flexion of the main member movement thereof into any small gap formed between the second backup element face and the opposite mating surface is prevented by the first backup element. The main member and backup elements may be provided separately or as an integral unit, and the first and second backup elements may be provided around the entire periphery of the main member, or only covering that portion thereof which is most subject to extreme variations of temperature, for example the main member portion lying adjacent to the area of the working chamber in which combustion of an explosive mixture takes place and from which combustion gas is evacuated, i.e., from the location of the spark plug to that of the exhaust port.

BRIEF DESCRIPTION OF THE DRAWINGS

The objects and features of the present invention will become apparent from the following description taken in conjunction with a preferred embodiment thereof with reference to the accompanying drawings, in which.

DETAILED DESCRIPTION OF THE INVENTION

Figure 1:
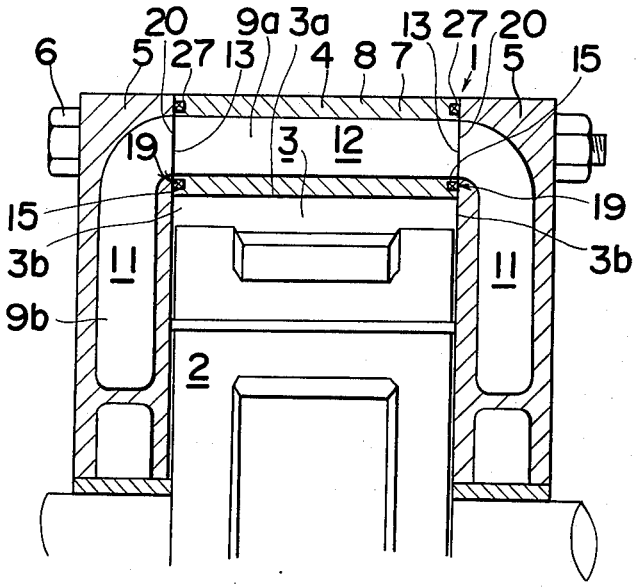
FIG. 1 is a longitudinal sectional view of the main parts of a rotary piston engine in the assembled condition.

Before the description of the present invention proceeds, it should be noted that, for the sake of brevity, like parts are designated by like reference numerals throughout the accompanying drawings.

Figure 2:
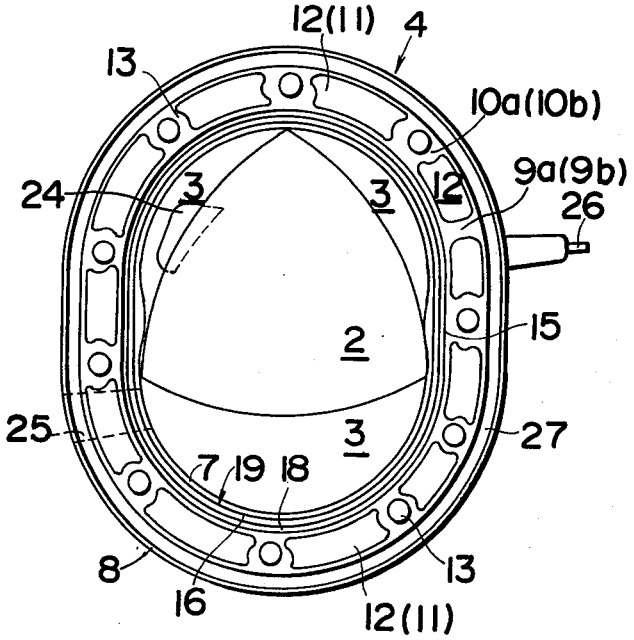
FIG. 2 is a transverse sectional view of a rotary piston engine wherein a second backup element of a seal means according to the invention is shown in enlarged form.

Referring to FIGS. 1 and 2, there is shown a casing 1 of a rotary piston engine comprising a generally elliptical main rotor housing 4, which is made of an aluminum base metal, has two open sides and defines a generally trochoidal peripheral wall 3*a* of a chamber 3, and side housings 5 which are made of cast iron base metal and are mounted in fixed attachment to opposite sides of the main housing 4 to define generally flat side walls 3*b* of the chamber 3, the mating surface 20 of each side housing 5 being in flush contact with the mating surface 13 of the corresponding side of the main housing 4. In the chamber 3 there is provided a three-lobed rotor 2, which connects via a suitable planetary gear train to a shaft rotatably mounted in the side housings 5 and being connected to mechanical elements to be driven, and is driveable in an epicyclical motion around the chamber 3 in a known manner. The lobe tips of the rotor 2 are in sliding but gas-tight contact with the chamber wall 3*a* defined by the main housing 4, and the sides of the rotor 2 are in similar contact with the chamber walls 3*b* defined by the side housings 5, whereby during epicyclical motion of the rotor 2 within the chamber 3 the rotor 2 divides the chamber 3 into gas-tight compartments, the volume of each of which is sucessively decreased and increased. An explosive mixture supplied via an intake port 24 into a chamber compartment defined between two lobes of the rotor 2 is compressed and brought to the location of a spark plug 26, which ignites the mixture, to produce an explosion to drive the rotor 2, burned gases being subsequently expelled by the rotor 2 from the chamber 3 via an exhaust port 25.

Still referring to FIGS. 1 and 2, within the actual body of the main housing 4 there are formed passages 12 through which a fluid coolant may flow, which are defined by a plurality of ribs 9*a* extending between the inner wall 7 and outer wall 8 of the main housing 4, and which have open ends communicating with opposite mating surfaces 13 of the main housing 4. Also, within the actual body of each side housing 5 there are formed passages 11 through which a fluid coolant may flow, and which have open ends communicating with the corresponding open ends of the main housing 4. Coolant flow passages 11 having openings communicating with a side housing mating surface 20 are similarly defined in each side housing 5 by a plurality of ribs 9*b* extending between the inner wall and outer wall of the side housing 5. In the ribs 9*a* and 9*b* of the main housing 4 and side housings 5 there are formed bolt holes 10*a* and 10*b* respectively permitting the fitting of bolt and nut assemblies 6, by which the side housings may be held in fixed attachment to the main housing 4, in which condition the openings of coolant flow passages 11 of the side housings 5 are aligned with openings of corresponding coolant flow passages 12 of the main housing 4 whereby the passages 11 and 12 constitute a continuous circuit around which coolant may flow. Coolant is suppliable into and removeable from this circuit by conventional suitable means, not indicated, in a known manner. In each mating surface 13 of the main housing 4, between the inner sides of the passages 12 and the main housing inner wall 7, there is formed an endless groove 15, which is generally elliptical in shape, roughly parallel to the line of the chamber peripheral wall 3*a*, and which accommodates a seal means according to the invention. As shown most clearly in FIG. 1, between the outer sides of the passages 12 and the outer wall 8 of the main housing 4 there similarly provided a seal means 27 which may be seal means according to the invention or a conventionally known seal means.

Figure 3:
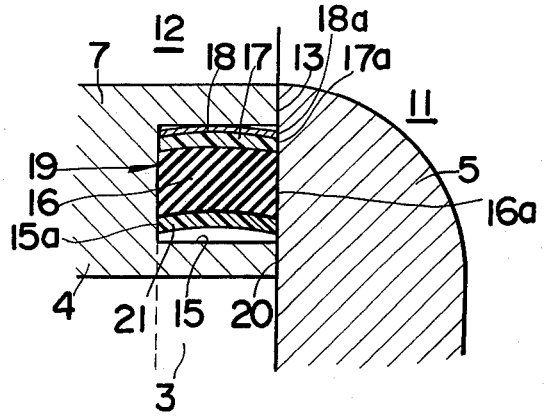
FIG. 3 is a greatly enlarged view of a seal means portion shown in FIG. 1.

Referring now to FIG. 3, each seal means 19 comprises a main member 16, which is suitably made of a heat-resistant, flexible elastomeric material, and which is comparatively thick and has a face to rear end dimension such that when a side housing 5 is assembled with the main housing 4 the main member 16 is compressively flexed between the rear wall 15*a* of the groove 15 and the side housing mating surface 20, the face 16*a* of the main member 16 being thus maintained in good sealing contact with a broad area of the side housing mating surface 20. Around the outer side of the main member 16, i.e., the side thereof nearer to the coolant passages 12 there is provided a first backup element 17, which is made of a material which is comparatively tough and flexible, but is slightly less flexible than the main member 16, and is much thinner than, but has approximately the same width as the main member 16, whereby the first backup element 17 is compressively flexed and the face 17*a* thereof presses firmly against and in good sealing contact with the side housing mating surface 20. A suitable material for the first backup element 17 is, for example, a fluoric resin such as polytetrafluroethylene. Around the outer side of the first backup element 17 there is provided a second backup element 18, which is suitably made of a rigid material such as steel, and which has a width which is slightly less than that of the main member 16 and first backup element 17, and is such that the second backup element face 18*a* may be in firm pressing contact with the side housing mating surface 20. In contact with the inner side of the main member 16 there is provided a heat resistant annular element 21, which may be made of, for example, polytetrafluoroethylene, copper, or steel, and which serves to protect the main member 16 from deterioration due to the effects of hot blow-by gases produced in the chamber 3.

The various abovedescribed components 16 through 18 and 21 of the seal means 19 may be provided as independently mountable and removable units, or two or more components may be bonded together as an integral unit. If all the seal means components are bonded together to constitute a single integral unit there is of course the advantage that mounting of the seal means is facilitated. Also, preferably, but not essentially, the total thickness of the seal means 19 is made somewhat less that the width of the groove 15, again from the point of view of facilitating mounting of the seal means, and also because such a dimension of the seal means 19 allows for any minor expansion thereof due to heat, and permits the seal means 19 to bend while remaining in good sealing contact with the mating surface 20 of the side housing 5 when there is any displacement of the side housing 5 relative to the main housing 4, thus avoiding abrasive wear of the seal means face by the mating surface 20.

Figure 4:
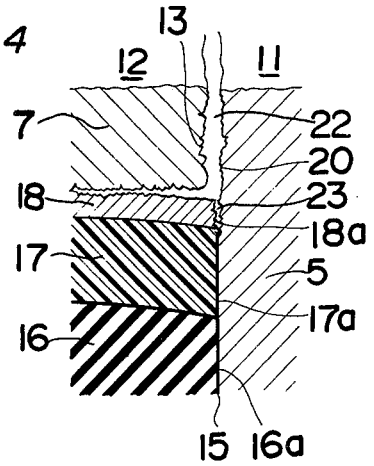
FIG. 4 is a further enlarged view of the seal means portion of FIG. 3.

Referring now to FIG. 4, which shows on an exaggerated scale the interface between housings 4 and 5 adjacent to the location of the seal means 19, due to the effects of abrasion and corrosion at an interface of the housings 4 and 5 there tends to be formed a gap 22 between the mating surfaces 13 and 20, and there is a smaller gap 23 between the face 18*a* of the second backup element 18 and the opposite mating surface 20. When the engine is in operation, due to effects of heat or vibration or other motion there is a varying amount of movement of the housings 4 and 5. Even if such movement occasions a comparatively large degree of bending of the main member 16, the second backup element 18, which is not sufficiently flexible to match the movement of the main member 16, prevents the first backup element 17 or main member 16 from partially moving into the gap 22. On the other hand, when engine motion or thermal effects result in minor deflection of the main member 16, the first backup element 17 prevents any portion of the main member 16 from working into the small gap 23. Thus according to the invention a rotary piston engine is provided with a seal means comprising a main member which is sufficiently thick to ensure that there is a good seal between engine casing coolant passages and the engine working chamber, and at the same time is effectively retained in a position wherein it is protected from undue wear, and is thus able to maintain a good seal for a longer time.

Figure 5:
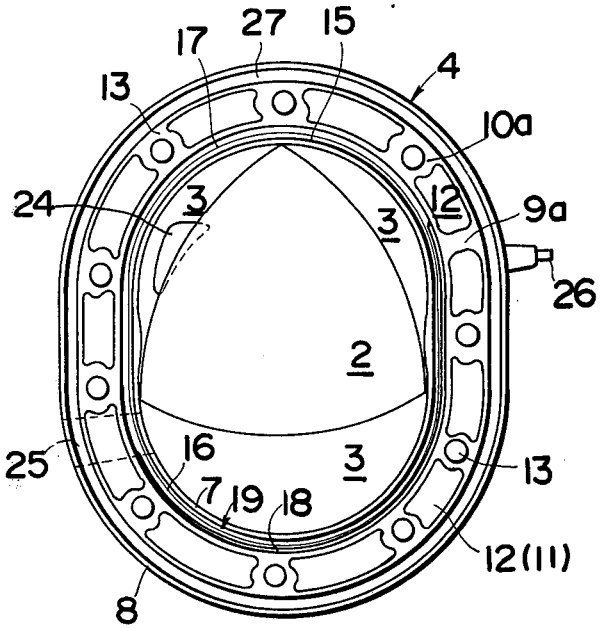
FIG. 5 is a transverse sectional view of a rotary piston engine equipped with a seal means having a partial second backup element in accordance with a second embodiment of the invention.

FIG. 5 shows another embodiment of the invention wherein the second backup element 18 is provided around only that portion of the periphery of the main member 16 which lies closest to that portion of the working chamber 3 in which there are the most extreme variations of temperature, i.e., the chamber portion wherein combustion of successive intakes of the explosive mixture takes place, and which extends generally from the location of the spark plug 26 to that of the exhaust port 25. In this case the first backup element 17 may be provided around the entire outer periphery of the main member 16, or may cover only the same portion thereof as the second backup element 18.

Figure 6:
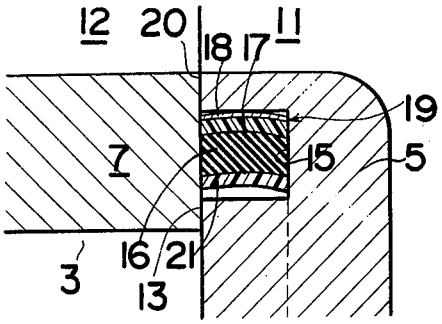
FIG. 6 is an enlarged sectional view showing an alternative manner of mounting a seal means.

As illustrated in FIG. 6, a seal means 19 according to the invention may fulfill the same function when mounted in a groove 15 which is formed in a side housing mating surface 20 instead of a mating surface 13 of the main housing 4.

From the foregoing full description of embodiments of the present invention, it has now become clear that, according to the present invention, seal means for an internal combustion engine such as a rotary piston engine which are provided at interfaces of the housings defining an engine working chamber and having formed therein passages constituting a circuit for flow of fluid coolant, and each of which is mounted in a groove means provided between the working chamber and coolant flow passages in at least one mating surface of a housing at an interface comprises a main member which is compressively flexed between the groove means and the opposite mating surface of a housing, a first backup element made of a flexible material such as a fluoric resin and second backup element made of a rigid material such as a thin metallic strip which are provided on the outer side of the main member, and a heat-resistant element which is provided on the inner side of the main member to protect the main member from the effects of heat produced by combustion of explosive mixtures in the working chamber, seal means components being providable as independently separable components or in attachment to one another to constitute one or more integral units. The rigid second backup element prevents movement of main member portions into any gap formed between housing mating surfaces at an interface, and the first backup element prevents movement of main member portions into any smaller gap formed between the second backup element and an opposite mating surface, whereby the main member is protected from wear and the service life of the seal means is increased. The first and second backup elements may be provided around the entire outer periphery of the main member, or around only those portions thereof most adjacent to working chamber areas wherein largest temperature variations occur.

Although the present invention has been fully described by way of example, it should be noted that various changes and modifications are apparent to those skilled in the art and, therefore, unless otherwise they depart from the true scope of the present invention they should be construed as included therein.

What is claimed is:

1. In a rotary piston internal combustion engine comprising a casing having a rotor housing provided with a trochoidal inner peripheral wall surface and a pair of side housings sealingly secured to the opposite sides of the rotor housing;

a polygonal rotary piston disposed in said casing for planetary revolution and rotation so as to define working chambers between the casing and the rotor, each of said working chambers being variable in volume during the planetary motion of said rotary piston to thereby perform four strokes of intake, compression, power and exhaust;

cooling fluid passage means provided in the side housings;

cooling fluid passage means axially extending through said rotor housing and communicating with said corresponding passage means in the side housings so as to allow flow of cooling fluid to pass from one of the side housings through said passage means in the rotor housing to the other side housing;

sealing grove means provided on at least one of the mating surface of the rotor housing and each of the side housings at an area between the passage means in the rotor housing and the inner peripheral wall surface and having a form of an ellipse;

the improvement comprising seal means fitted in the sealing groove means to prevent the leakage of the cooling fluid from the passage means into the working chamber;

said seal means being a seal member having a heat-resistant rubber body to prevent the leakage of the cooling fluid from the passage means to the working chamber;

a first backup layer made of synthetic resin having less elasticity than the seal member and provided on the outer peripheral face of the seal member, which face is directed toward the cooling fluid passage of the rotor housing; and a second backup layer made of metal plate having less elasticity than the first backup layer and provided on the outer peripheral face of the first backup layer, which face is directed toward the cooling fluid passage of the rotor housing.

2. The improvement as claimed in claim 1, wherein said metal plate is steel plate.

3. The improvement as claimed in claim 1, wherein said sealing groove means is provided in each of mating surfaces of said side housings.

4. The improvement as claimed in claim 1 wherein said synthetic resin is fluoric resin.

5. The improvement as claimed in claim 4, wherein said fluoric resin is polytetrafluoroethylene.

6. The improvement as claimed in claim 4, wherein said metal plate is steel plate.

7. The improvement as claimed in claim 4, wherein said fluoric resin is integrally attached to the seal member so as to cover at least a portion of the seal member.

8. The improvement as claimed in claim 1, wherein said first backup layer extends over the entire circumference of the seal member.

9. The improvement as claimed in claim 8, wherein said first backup layer is integrally attached to the seal member.

10. The improvement as claimed in claim 8, wherein said second backup layer extends over the entire circumference of the first backup layer.

11. The improvement as claimed in claim 8, wherein said second backup layer is positioned in the area of the power and exhaust strokes of the working chamber.

12. The improvement as claimed in claim 1 wherein said second backup layer extends at least partly over the circumference of the first backup layer.

13. The improvement as claimed in claim 12, wherein said second backup layer is positioned in the area of the power and exhaust strokes of the working chamber.

14. The improvement as claimed in claim 12, wherein said areas covers from a spark plug to an outlet port.

15. The improvement as claimed in claim 1, wherein said sealing groove means is provided in each of said mating surfaces of said rotor housing.

16. The improvement as claimed in claim 15, wherein said rotor housing is made of aluminum or alloy thereof, said side housings is made of cast iron, said metal plate is steel plate and said synthetic resin is fluoric resin.

17. An internal combustion engine comprising: a working chamber having a generally trochoidal peripheral wall, having therein a polygonal, epicyclically rotatable rotor which during rotation thereof divides said chamber into a plurality of gas-tight compartments each having a continually varying volume, said working chamber having in connection therewith an intake means, ignition means, and exhaust means, whereby an explosive mixture is supplied into and compressed and ignited in said chamber, and combustion gases are evacuated therefrom; housing means defining said chamber and having a main housing with an inner peripheral portion constituting said generally trochoidal wall of said chamber and opposite side portions defining mating surfaces, and side housings each having a surface portion defining a mating surface fittable against a mating surface on one side of said main housing, and fixedly attached to said main housing and defining the side walls of said chamber, there being provided within each said housing coolant passages for flow of coolant therethrough and connectable to an external means for supply and removal of coolant thereinto and therefrom, said passages in said main housing communicating with said passages in said side housings, and there being provided in at least one said housing mating surface at each interface between the main housing and said side housings a sealing groove means having the general form of an ellipse having major and minor axes greater than those of said chamber in longitudinal section and lying on a line located between said chamber wall defined by said main housing and said coolant passages in said housings; and seal means provided in each said groove means and comprising a main member made of a heat-resistant and flexible rubber, dimensionally constituting the major portion of said seal means, and having a width such that when said housings are in an assembled condition said main member is compressed between said groove means and the opposed mating surface at said interface, a flexible first backup element made of synthetic resin which is thinner than, has approximately the same width as, and has less flexibility than said main member, and is in contact with the side of said main member which is the outer side thereof with respect to said chamber, and extends over at least part of the periphery of said main member, a rigid second backup element made of metal plate which is thinner than and is provided on the outer side of said first backup element and extends over at least part of the periphery of said main member, and has a width such that when said housings are in an assembled condition the rear surface of said second backup element contacts a rear portion of said groove means and the face is in contact with the opposed mating surface at said interface, and a heat-resistant element which is thinner than, has the same general width as and is in contact with the entire length of the inner side of said main member.

* * * * *